US009099791B2

(12) United States Patent
Yang

(10) Patent No.: US 9,099,791 B2
(45) Date of Patent: Aug. 4, 2015

(54) CABLE ASSEMBLY HAVING A COAXIAL CABLE WITH OUTER CONDUCTOR NOT PROTRUDING A HOUSING SURROUNDING THE CABLE

(71) Applicant: Tektronix, Inc., Beaverton, OR (US)

(72) Inventor: Kei-Wean C. Yang, Beaverton, OR (US)

(73) Assignee: TEKTRONIX, INC., Beaverton, OR (US)

( * ) Notice: Subject to any disclaimer, the term of this patent is extended or adjusted under 35 U.S.C. 154(b) by 20 days.

(21) Appl. No.: 14/063,316

(22) Filed: Oct. 25, 2013

(65) Prior Publication Data

US 2014/0377989 A1 Dec. 25, 2014

Related U.S. Application Data

(60) Provisional application No. 61/838,170, filed on Jun. 21, 2013.

(51) Int. Cl.

| | |
|---|---|
| ***H01R 9/05*** | (2006.01) |
| ***H01R 24/40*** | (2011.01) |
| *H01R 13/648* | (2006.01) |

(52) U.S. Cl.

CPC ..... *H01R 9/05* (2013.01); *H01R 24/40* (2013.01); *H01R 13/6485* (2013.01); *H01R 2201/20* (2013.01)

(58) Field of Classification Search

CPC ..... H01R 9/05

USPC ..... 439/578–585

See application file for complete search history.

(56) References Cited

U.S. PATENT DOCUMENTS

| | | | | |
|---|---|---|---|---|
| 3,676,744 | A * | 7/1972 | Pennypacker | 333/125 |
| 5,926,076 | A * | 7/1999 | Johnson et al. | 333/109 |
| 6,252,391 | B1 * | 6/2001 | McAllister et al. | 324/149 |
| 6,876,183 | B2 * | 4/2005 | Cannon | 324/72.5 |
| 7,282,679 | B2 | 10/2007 | Reichinger | |
| 2003/0107382 | A1 | 6/2003 | Kreager et al. | |
| 2011/0201232 | A1 | 8/2011 | Islam | |
| 2013/0012063 | A1 | 1/2013 | Thomas et al. | |

FOREIGN PATENT DOCUMENTS

| | | | |
|---|---|---|---|
| EP | 0102166 | A1 | 3/1984 |
| EP | 0220445 | A1 | 5/1987 |
| EP | 1124288 | A1 | 8/2001 |
| WO | 9528750 | A1 | 10/1995 |

OTHER PUBLICATIONS

Extended European Search Report, European Patent Application No. 14172943.4, dated Oct. 23, 2014, 9 pages, The Hauge, The Netherlands.

* cited by examiner

*Primary Examiner* — Chandrika Prasad

(74) *Attorney, Agent, or Firm* — Marger Johnson & McCollom PC; Thomas F. Lenihan

(57) ABSTRACT

A cable assembly including a coaxial cable having active components mounted thereon, a housing substantially surrounding the coaxial cable, and a launch connector mounted to the outside of the housing and in connection with the coaxial cable.

13 Claims, 4 Drawing Sheets

CABLE ASSEMBLY HAVING A COAXIAL CABLE WITH OUTER CONDUCTOR NOT PROTRUDING A HOUSING SURROUNDING THE CABLE

TECHNICAL FIELD

This disclosure relates to electrical connectors and specifically concerns over high frequency small signal connectors.

BACKGROUND

It can be desirable for high frequency electrostatic damage (ESD) protectors to have short physical lengths. ESD protector solutions based on slotted semi-rigid coaxial cable structures, such as shown in FIG. 1, can meet the required performance requirements for high frequency. When applying the structure of FIG. 1, however, to build a short cable length design, as seen in FIG. 2, a high failure rate was encountered during testing and handling of the short cable lengths.

The ESD protection device 100 as shown in FIG. 1 was proven effective for long semi-rigid coaxial cables. The ESD protection device 100 includes active components in active component slots 102. When a cable is connected to the ESD protection device 100, the inner conductor (not shown) attached to the active component does not rotate when the cable is connected due to the bend in the EDS protection device, seen in FIG. 1.

A very high failure rate was found when the cable length was shortened and the bent section removed to fit the form factor requirements of a sampling oscilloscope product line such as an external time-domain reflectometer (TDR) module protector. The shortened ESD protection device 200 fails because the fragile active components in active component slots 102 are torn apart due to a center cable conductor of the ESD protection device 200 is rotated from its original position, which tears the active components in the active component slots 102. A shortened cable does not have enough PTFE, or Teflon, to hold the center conductor in place. As a result, the cable center conductor will rotate along with the soldered on connector center pin as it rotated by a user. Rotation of this center conductor drags one of the attached arms of the active components in the active components slot 102 and rips them apart because each of the active components' arms are still attached to the stationary outer conductor. It turns out that center pin rotation on SMA (SubMiniature version A) style high frequency connectors has historically been a problem and troubled the industry for some time. The triggering action is that users usually often inadvertently rotate the body of the mating parts instead of just rotating the connector coupling nut as the user should when engaging the connectors. This causes the active components in the active component slots 102 to tear in the shortened ESD protection device 200. As discussed above, the bend shown in FIG. 1 protects the inner conductor in the longer ESD protection device 100 from being rotated and damaging its installed active components.

Accordingly, a need remains for an ESD protection device 200 which is short in length and does not include the bend of the ESD protection device 100, but that prevents tearing of the active components in the active component slots 102 when connected to a cable.

SUMMARY

Certain embodiments of the disclosed technology include a cable assembly, comprising a coaxial cable having active components mounted thereon, a housing substantially surrounding the coaxial cable, and a launch connector mounted to the outside of the housing and in connection with the coaxial cable.

Other embodiments of the disclose technology include a system, comprising a device under test; a test and measurement instrument; and a cable assembly. The cable assembly includes a coaxial cable having active components mounted thereon; a housing substantially surrounding the coaxial cable; and two launch connectors mounted to the outside of the housing and in connection with the coaxial cable. One of the launch connectors attaches the cable assembly to the device under test and the other launch connector attaches the cable assembly to the test and measurement instrument.

DETAILED DESCRIPTION

Figure 1:
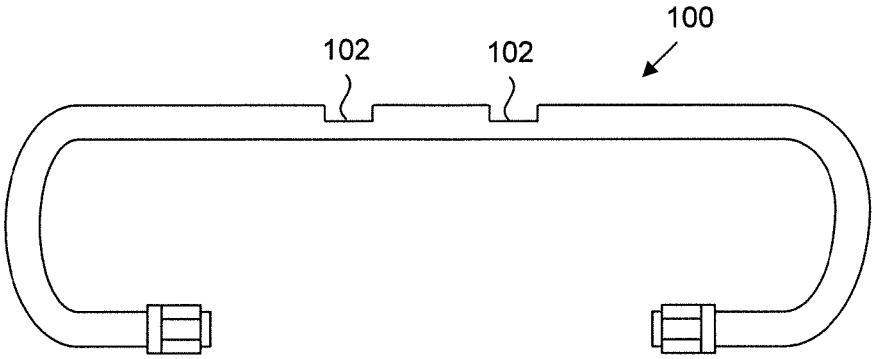
FIG. 1 PRIOR ART
FIG. 1 illustrates a prior art ESD protection device.

In the drawings, which are not necessarily to scale, like or corresponding elements of the disclosed systems and methods are denoted by the same reference numerals.

The disclosed technology relates to a special technique to incorporate a slip joint between a launch connector pin receptacle and an inner conductor of a coaxial cable so that rotation of a center pin of the launch connectors does not result in rotation of the inner conductor of the coaxial cable. The coaxial cable includes parallel mounted fragile active components in the active component slots 102. The fragile active components in the active component slots 102 may be, for example, diodes (not shown).

Figure 3:
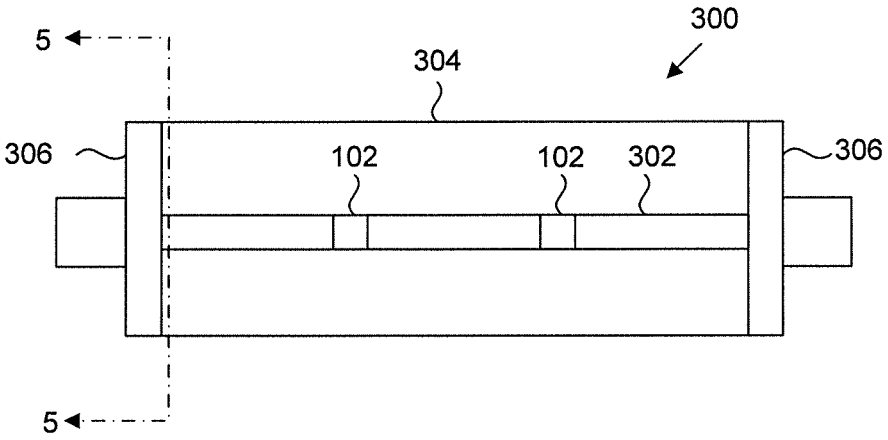
FIG. 3 illustrates a top view of a cable assembly of the disclosed technology.

In the disclosed technology, instead of using a solder on connector like typical coaxial cables do, a cable assembly 300 is divided into three sections. The cable assembly 300, as shown in FIG. 3, includes a coaxial cable 302 located within a housing 304. Attached to the housing 304 are two launch connectors 306. The launch connectors 306 attach the cable assembly 300 to other cables which may be connected to a device or a test and measurement instrument.

Preferably, the launch connectors 306 are standard edge launch connectors, such as 2.4 mm connectors sold by Southwest Microwave, Inc. Launch connectors 306 used in the disclosed technology are preferably launch connectors designed for microwave transmission from a coaxial cable environment to a stripline or micro strip line. Any launch connection, however, may be used. Launch connectors usually have various diameter launch pins available. In the disclosed technology, however, the launch pins are not used with the launch connector 306, as will be described more fully below. The launch connector 306 does not have to take the shape of that shown in FIGS. 3 and 5. For example, a narrower two hole mounting launch connector 306 may be used. Any launch connector that has a launch pin receptacle, as discussed more fully below, may be used.

Figure 2:
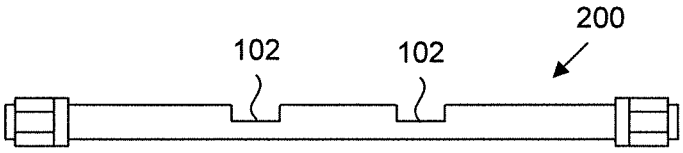
FIG. 2 PRIOR ART
FIG. 2 illustrates another prior art ESD protection device.
Figure 4:
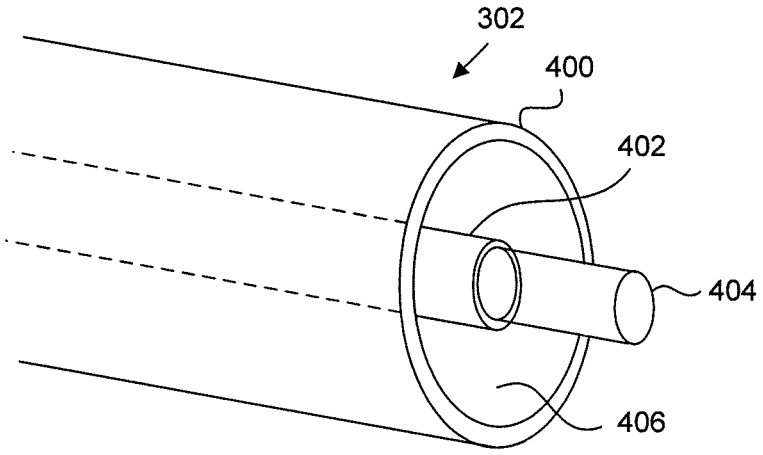
FIG. 4 illustrates the conductor of FIG. 3.

The coaxial cable 302, shown in more detail in FIG. 4, includes an outer conductor 400, an inner conductor with two portions 402 and 404, and a dielectric layer 406. A portion of the inner conductor 402 is located within the housing 304 (hereinafter inner portion of the inner conductor 402) and a portion of the inner conductor 404 is located outside the house (hereinafter the outer portion of the inner conductor 404), as will be discussed in more detail below with respect to FIG. 6. FIG. 4 shows one end of the coaxial cable 302. Although not shown, the opposite end of the cable would have the same configuration as shown in FIG. 2. Preferably the coaxial cable 302 is a low loss 0.086 inch diameter semi-rigid coaxial cable. Any coaxial cable, however, may be used.

Figure 5:
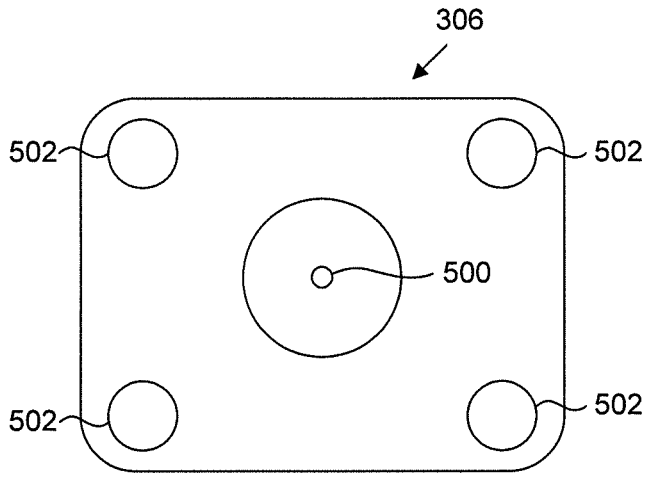
FIG. 5 illustrates an end view of a launch connector along lines 5-5 in FIG. 3.

The portion of the inner conductor 404 located outside the housing fits inside the launch pin receptacle 500 of the launch connector 306, shown in FIG. 5, where normally a launch pin would be inserted. This allows the radio frequency signal to travel from the launch connector 306 into the cable assembly 300 or from the cable assembly 300 to the launch connector 306. The length of the inner conductor 404 allows for the inner conductor 404 to extend out from the housing 304 outer wall just enough to mate with the launch pin receptacle 500 without bottoming out. The housing 304 discussed above maintains transmission line integrity. Further, the housing 304 holds and aligns the coaxial cable 302 to the launch connectors 306. That is, the launch connectors 306 are screwed onto the housing 304 via holes 502 in the launch connector 306. The housing 304 must have a very accurate dimensional control so that the outer portion of the inner conductor 404 is outside the housing 304, as described above and in further detail below.

Figure 6:
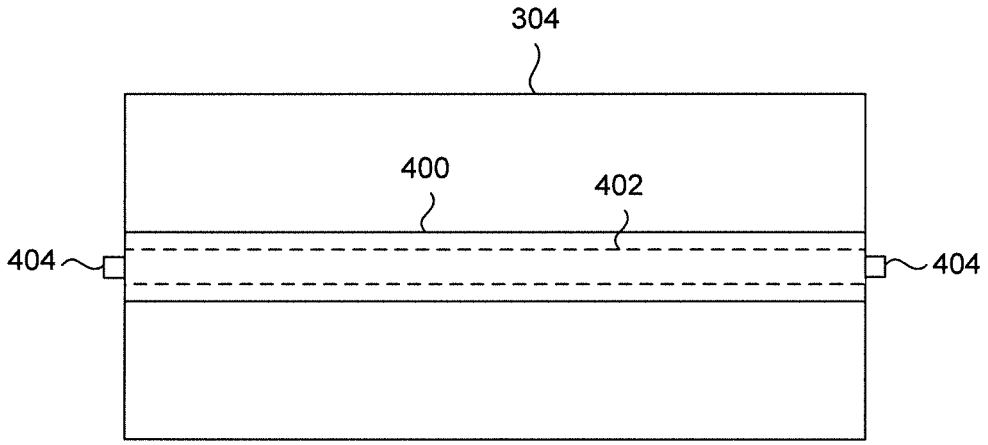
FIG. 6 illustrates the conductor of FIG. 4 within the housing of FIG. 3.

As shown in FIG. 6, the outer conductor 400 of the coaxial cable is dimensioned to be the exact length of the housing 304. The outer portion of the inner conductor 404 is dimensioned to extend beyond an outer wall of the housing 304 by approximately 0.045 inches. The inner portion of the inner conductor 402, however, is dimensioned to be the exact length of the housing 304 and the outer conductor 400. That is, the outer portion of the inner conductor 404 extends beyond the housing 306. The inner portion of the inner conductor 402 located within the housing 304 has a diameter preferably approximately 0.022 inches. The diameter of the portion of the inner conductor 404 located outside the housing is reduced to 0.018 inches. Further, the portion of the inner conductor 404 located outside the housing may be beveled. The beveling helps fit the outer portion of the inner conductor 404 into the launch pin receptacle 500 of the launch connector 306.

When a cable, such as an SMA cable, is attached to the cable assembly 300, the cable's connecting nut is screwed on to the launch connector 306. Because the inner conductor 402 and 404 is located within the launch pin receptacle 500 of the launch connector 306, the inner conductor 402 and 404 can rotate freely relative to the launch pin receptacle 500 and not follow the rotational movement of the launch pin receptacle 500. This prevents the inner conductor 402 and 404 from rotating separately from the outer conductor 400 which in turn prevents the fragile active components in active component slots 102 on the coaxial cable 302 from tearing when the cable assembly 300 is attached to another mating connector of a cable or an instrument. That is, the launch pin receptacle 500 of the launch connector 306 and the inner conductor 402 and 404 of the coaxial cable 302 can rotate separately from each other.

The inner conductor 404 located outside the housing is plated with at least 30 micro inches thick gold and a 50 micro inches nickel barrier under the gold. Further, the end portions of the outer conductor 302 are also plated as well with at least 30 micro inches thick gold and a 50 micro inches nickel barrier under the gold. This plating ensures that while the exact contacting point is slipping along between the launch pin receptacle 500 and the inner conductor 404, a reliable low resistance path is always maintained between the two bodies. High frequency ESD protectors built with this slip joint comprised of the cable assembly 300 and the launch connectors 306 have proven to be reliable in maintaining good electrical contacts and very effective in suppressing tearing failures of the active components within the active component slot 102.

Although the housing has been substantially in a rectangular shape, one of ordinary skill in the art will understand that the housing can take on other shapes as well, such as cylindrical.

Figure 7:
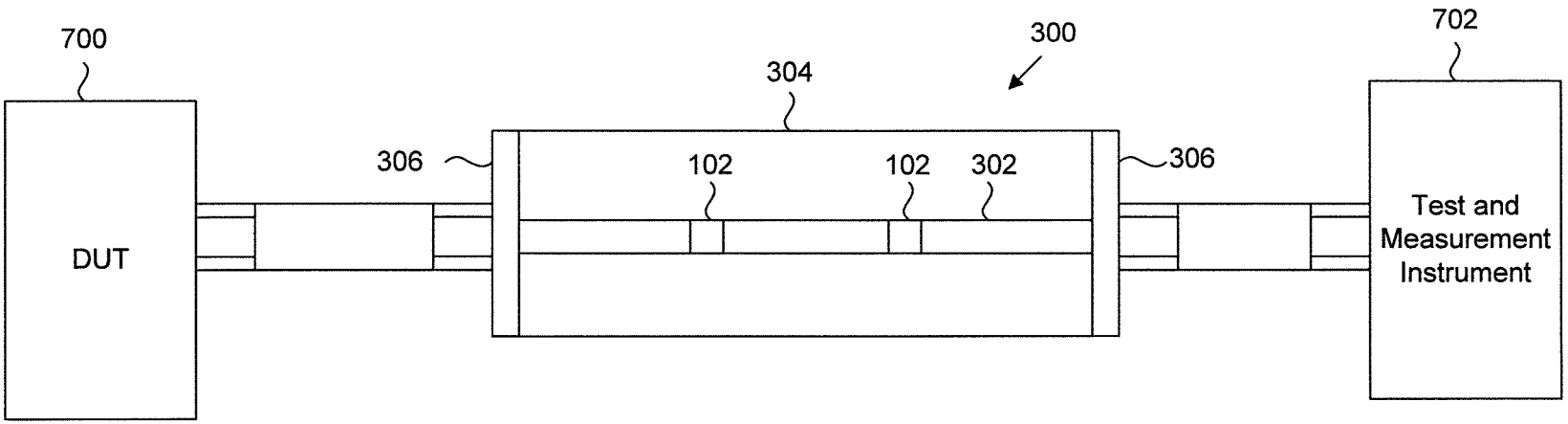
FIG. 7 illustrates a system using the cable assembly of FIG. 3.

FIG. 7 illustrates a system in which an ESD protector built using the design of cable assembly 300 is used to protect a test and measurement instrument 702, such as an oscilloscope, while measuring a device under test 700. One of the launch connectors 306 attaches to a cable that leads to the device under test 700. The other launch connector 306 attaches to the test and measurement instrument 702. This allows high frequency measurement to be carried out safely without risk of ESD damages to the test and measurement instrument. The cable assembly shown in FIG. 7 uses the same cable assembly 300 discussed above with respect to FIGS. 3-6.

Having described and illustrated the principles of the disclosed technology in a preferred embodiment thereof, it should be apparent that the disclosed technology can be modified in arrangement and detail without departing from such principles. We claim all modifications and variations coming within the spirit and scope of the following claims.

What is claimed is:

1. A cable assembly, comprising;

a coaxial cable, having active components mounted thereon, including an inner conductor and an outer conductor;

a housing substantially surrounding the coaxial cable, wherein the outer conductor does not protrude beyond the housing; and a launch connector mounted to the outside of the housing and in connection with the coaxial cable.

2. The cable assembly of claim 1, wherein the outer conductor is connected to ground.

3. The cable assembly of claim 1, wherein a portion of the inner conductor extends beyond an outer wall of the housing and connects to a connector receptacle of the launch connector.

4. The cable assembly of claim 3, wherein the inner conductor extends beyond the outer wall of the housing by approximately 0.045 inches.

5. The cable assembly of claim 3, wherein at least 30 micro inches thick gold with a 50 micro inches nickel barrier layer underneath is plated onto the portion of the inner conductor that extends beyond the outer wall of the housing as well as around the outer conductor near the edge.

6. The cable assembly of claim 3, wherein the inner conductor has a diameter of approximately 0.022 inches inside the housing and a diameter of approximately 0.018 inches outside the housing.

7. The cable assembly of claim 3, wherein the portion of the inner conductor that extends beyond the outer wall of the housing is beveled.

8. The cable assembly of claim 1, wherein the cable is a low loss 0.086 inch diameter semi-rigid coaxial cable.

9. A system, comprising:

a device under test;

a test and measurement instrument; and a cable assembly, including:

a coaxial cable, having active components mounted thereon, including an inner conductor and an outer conductor;

a housing substantially surrounding the coaxial cable, wherein the outer conductor does not protrude beyond the housing; and two launch connectors mounted to the outside of the housing and in connection with the coaxial cable, wherein one of the launch connectors attaches the cable assembly to the device under test and the other launch connector attaches the cable assembly to the test and measurement instrument.

10. The system of claim 9, wherein the outer conductor is connected to ground and is only as long as the length of the housing.

11. The system of claim 9, wherein a portion of the inner conductor extends beyond an outer wall of the housing and connects to a connector receptacle of the launch connector.

12. The system of claim 11, wherein the inner conductor extends beyond the outer wall of the housing by approximately 0.045 inches.

13. The system of claim 11, wherein the inner conductor has a diameter of approximately 0.022 inches inside the housing and a diameter of approximately 0.018 inches outside the housing.

* * * * *

UNITED STATES PATENT AND TRADEMARK OFFICE

CERTIFICATE OF CORRECTION

PATENT NO. : 9,099,791 B2
APPLICATION NO. : 14/063316
DATED : August 4, 2015
INVENTOR(S) : Kei-Wean C. Yang It is certified that error appears in the above-identified patent and that said Letters Patent is hereby corrected as shown below:

In the Claims

In column 5, lines 14-15, delete "and is only as long as the length of the housing"

Signed and Sealed this
Fifteenth Day of March, 2016

Michelle K. Lee

Michelle K. Lee
*Director of the United States Patent and Trademark Office*